United States Patent [19]

Grati

[11] Patent Number: 4,561,706

[45] Date of Patent: Dec. 31, 1985

[54] HOLLOW PUNCHED OBJECT FOR FORMING A STRUCTURE WITH BOX WALLS

[75] Inventor: Giorgio Grati, Milan, Italy

[73] Assignee: Ograd s.r.l., Milan, Italy

[21] Appl. No.: 731,609

[22] Filed: May 7, 1985

Related U.S. Application Data

[63] Continuation of Ser. No. 447,507, Dec. 6, 1982.

[30] Foreign Application Priority Data

Dec. 4, 1981 [IT] Italy ..... 23711/81[U]
Dec. 4, 1981 [IT] Italy ..... 23712/81[U]

[51] Int. Cl.[4] ..... A47B 43/00; B65D 5/22

[52] U.S. Cl. ..... 312/258; 312/259; 312/350; 229/34 R; 108/51.3

[58] Field of Search ..... 312/258, 259, 257 SK, 312/257 SM, 336, 350; 108/51.3, 56.3, 153; 229/34 R, 34 HW; 206/491; 5/DIG. 1

[56] References Cited

U.S. PATENT DOCUMENTS

| | | | |
|---|---|---|---|
| 2,217,504 | 10/1940 | Bergstein | 229/34 R |
| 2,455,739 | 12/1948 | Curtis | 312/259 |
| 2,547,463 | 4/1951 | Haut | 312/350 |
| 3,136,473 | 6/1964 | Kieffer | 229/34 HW |
| 3,321,259 | 5/1967 | Fiterman et al. | 312/259 |
| 3,373,923 | 3/1968 | Martelli | 229/34 R |
| 3,499,597 | 3/1970 | Katzman | 229/34 HW |
| 3,550,978 | 12/1970 | Magee | 312/350 |
| 3,784,083 | 1/1974 | Pfaffendorf et al. | 312/259 |
| 4,080,023 | 3/1978 | Bair | 312/259 |
| 4,295,599 | 10/1981 | Locatelli et al. | 312/258 |

FOREIGN PATENT DOCUMENTS

| | | | |
|---|---|---|---|
| 801574 | 12/1968 | Canada | 229/34 HW |
| 930263 | 7/1963 | United Kingdom | 108/51.3 |
| 996516 | 6/1965 | United Kingdom | 108/51.3 |

*Primary Examiner*—Victor N. Sakran
*Attorney, Agent, or Firm*—Fleit, Jacobson, Cohn & Price

[57] ABSTRACT

An object that may be shaped by means of folding in a tri-dimensional box-like structure, comprises a main blank consisting of a bottom panel defined by score lines along the sides and by lateral sections extending beyond said score lines; at least, one section is lateral and consists of several members that may be folded among themselves in a box-like way, so as to form a side of the structure with an, at least partially, box-like shape.

10 Claims, 14 Drawing Figures

FIG.5
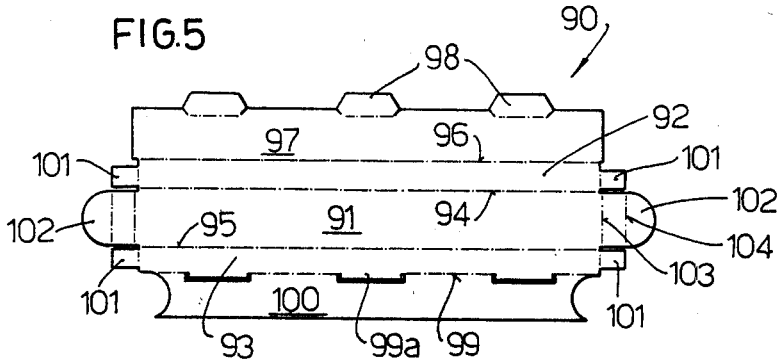
FIG.6
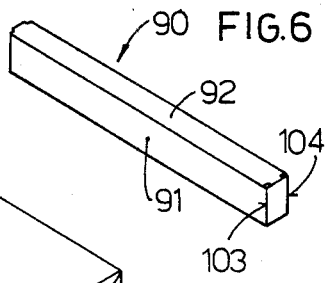
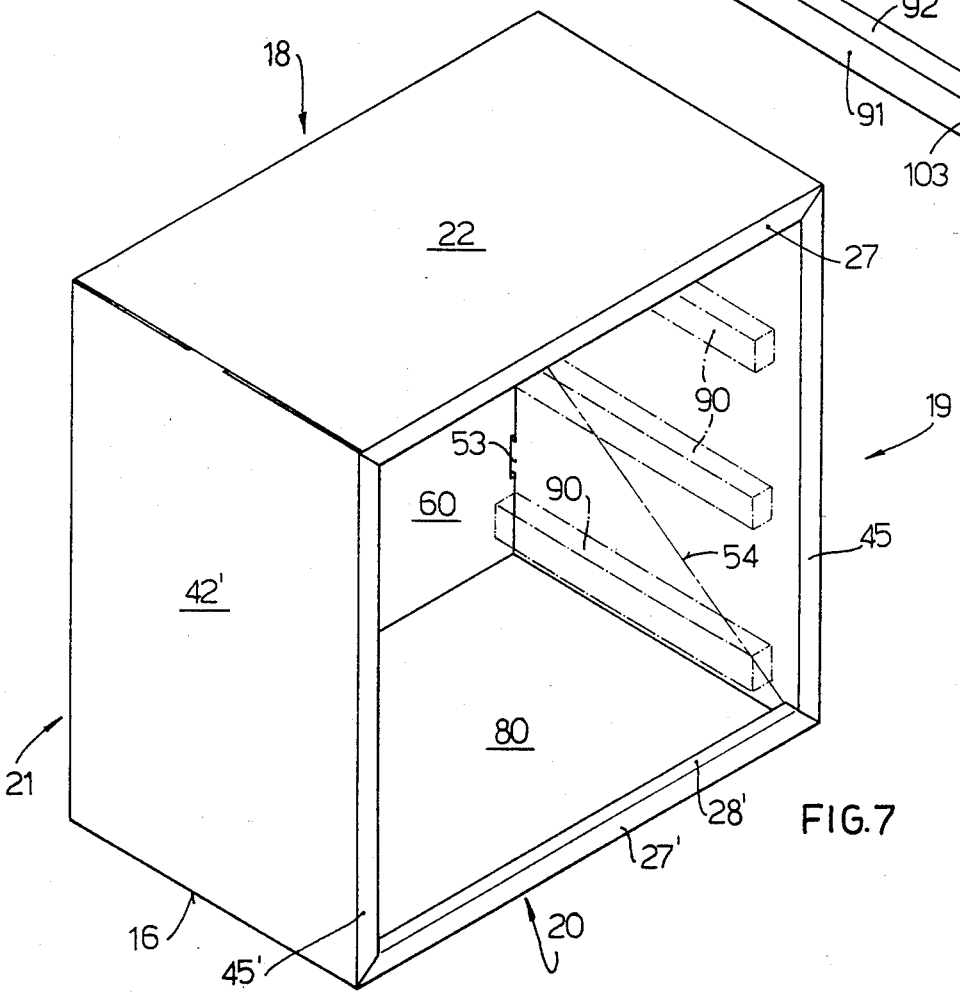
FIG.7

HOLLOW PUNCHED OBJECT FOR FORMING A STRUCTURE WITH BOX WALLS

This application is a continuation of application Ser. No. 447,507, filed Dec. 6, 1982.

This application is concerned with objects made of material in the form of a sheet, in which the sheet material has been endowed with a specially contoured shape and with a particular arrangement of the folding lines, or rather score lines, so that the material is ready to form, by means of folding (bending) boxes, or in some way, containers. In the following, each sheet used for said objects shall be called a blank ("fustellato").

The most widely varying kinds of containers obtained from punch-cuttings, and punch-cuttings to manufacture such containers, are known.

The aim of the application is the realisation of a hollow-punched object that may be converted, easily and rapidly, into a very stable, good-looking container that is suitable, e.g., to be used as a piece of furniture.

That aim has been achieved by means of an object that contains, at least, one blank article comprising, essentially, a base panel and lateral sections that extend from the sides of said base section and may be folded along the score lines; at least, one and preferably two opposite lateral sections may be folded, so that each forms a box-like lateral wall for the container. An object in accordance with this application, comprises a main blank with a quadrangular base panel the sides of which are bordered by score lines. From each side of the panel, lateral sections extend, which are -two by two-alike, and which may be folded so as to form a three-dimensional box-like structure; in addition, every lateral section may be doubled up, in such a way that said box-like structure be such as to constitute an especially rigid unit.

Preferably, blank reinforcement members are provided for the base of the object and for two opposite sides. The assembled object may be used as a book shelf or, if desired, as a supporting structure for drawers, after the application of slideways which, by preference, may be mounted from a blank on the inner lateral walls of the assembled structure.

Within the main blank, a couple of said opposite lateral sections comprises a first member extending from the bottom panel, several parallel strips defined by seams on the end of said member, on the end of said member facing the panel, and a terminal tongue that may be folded against the member, said member being defined on each side by a score line beyond which another member extends; every one of said further members is extended farther, on one side, toward the outside of, at least, one strip and one subsequent tongue as defined by a score line; said further members may be folded at an angle of 90° in relation to said first members.

Every lateral section of the second couple of lateral sections comprises a first member extending from the bottom panel, a strip that is adjacent to same and defined by score lines that are parallel to the score line of the bottom panel, and a second member that extends beyond said strip and has substantially the same height as the first member. Notches and fastening tongues have been provided on one and/or the other couple of lateral sections, for reciprocal blocking, in a known manner.

The members for the reinforcement of the bottom consist of a pair of blanks having altogether—once they have been assembled—dimensions that are substantially equal to the bottom panel of the main blank; each blank of the pair comprises a panel with a serrated edge and a foldable tongue on the other edge, while the teeth of the two reinforcement blanks have complementary forms so that they may be able to become engaged and act in opposition to one another.

The lateral reinforcing members consist, in general, of a pair of members either one of which comprises: a panel that is substantially of the size of the side to be reinforced; a tongue that may be folded along the bottom panel of the main punch-cutting, and toothing at the end facing of the tongue and designed to become engaged in the pre-arranged notches in the side to be reinforced. The eventual slide-guides generally consist—every one of them—of a blank comprising two or, by preference, three panels at a distance from the region of the strips; the blank of the guide may be folded, in such a way that two end panels overlap and form a shape similar to a stretched parallelepiped.

A further blank article in accordance with this application comprises, essentially, a panel with a quadrangular base, on each side of which sections extend that are intended to make up the walls of the container; at least, some of said sections themselves may be folded in a box-shape, so as to produce a container that is strong and essentially non-deformable. The assembled container has, at least, lateral walls with a stepped recess near the bottom, so that it may be used as a drawer in a box, due to the fact that the lateral walls may be supported by, and can slide along, the supprting guides; the frontal section of the container has, by preference, a means of taking hold that consists, in general, of a notch.

In particular, the lateral sections of the blank have, starting from the central panel, a first member that is adjacent to the bottom panel, a first strip, a second member, a second strip, and a locking tongue which are connected with one another along score lines. The front section comprises, when we proceed from the bottom panel toward the outside, a first member, a first strip, a second member, a second strip, a tongue for fastening, all of which are separated from one another by means of a score line. The back section comprises, proceeding from the central panel, a first strip and a second strip, adjacent to the first strip, the two strips, being separated from one another by means of a score line.

A more detailed description will be given in the following, with reference to the drawings attached hereto:

FIG. 5 shows a slide way blank designed to serve as a slideway for drawers of the object of this application.

FIG. 6 is a perspective view of a guide assembled from the blank of FIG. 5.

FIG. 7 is a perspective view of the assembled object starting from the blanks of FIGS. 1, 2, 3, 4 with possible slide-ways shown by dotted lines.

the part that is not shown, is symmetrical with the one shown in relation to an axis b.

Figure 9:
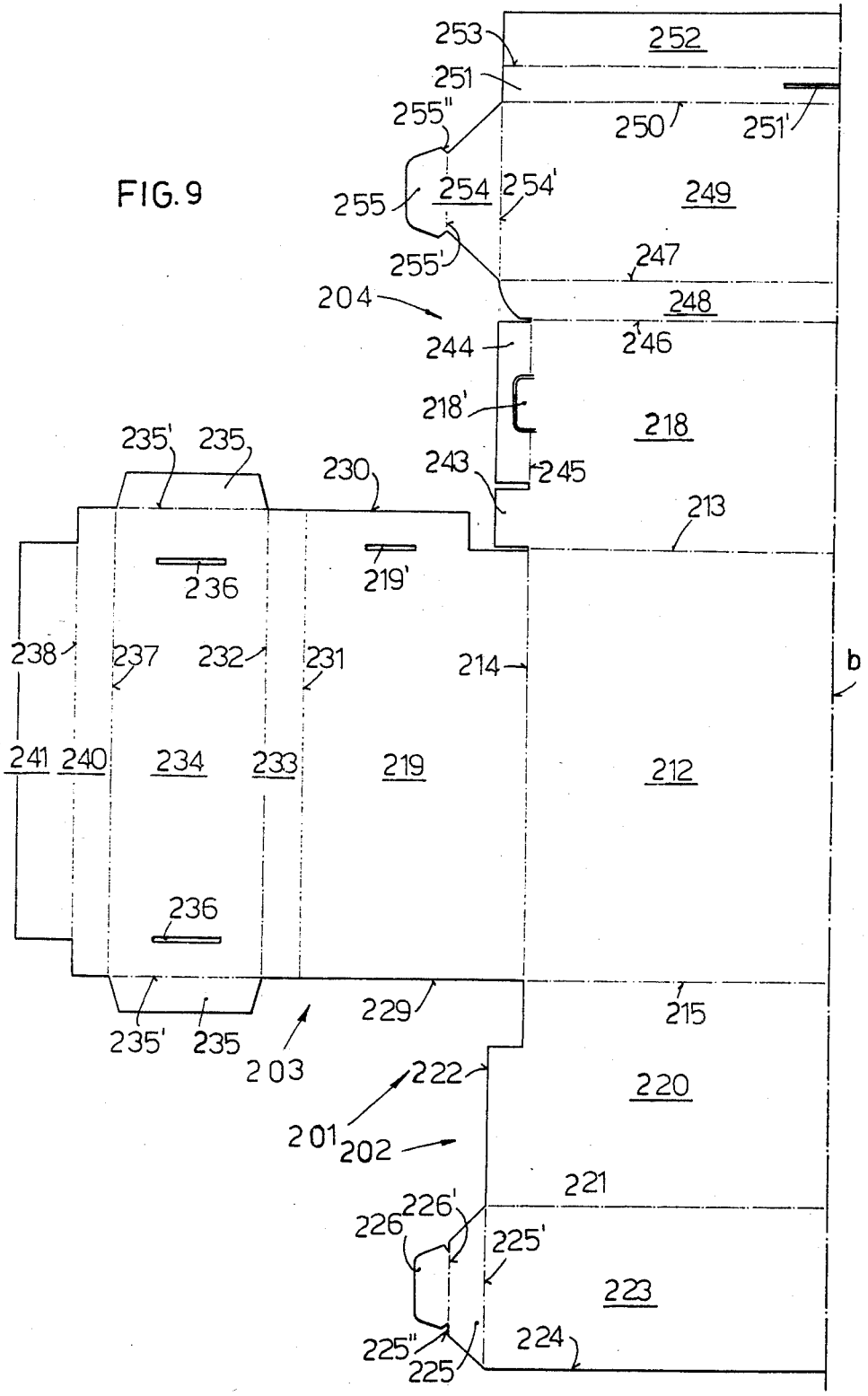
FIG. 9 is a plan view of a blank for a second object of this application as drawn spread out and in part only.
Figure 10:
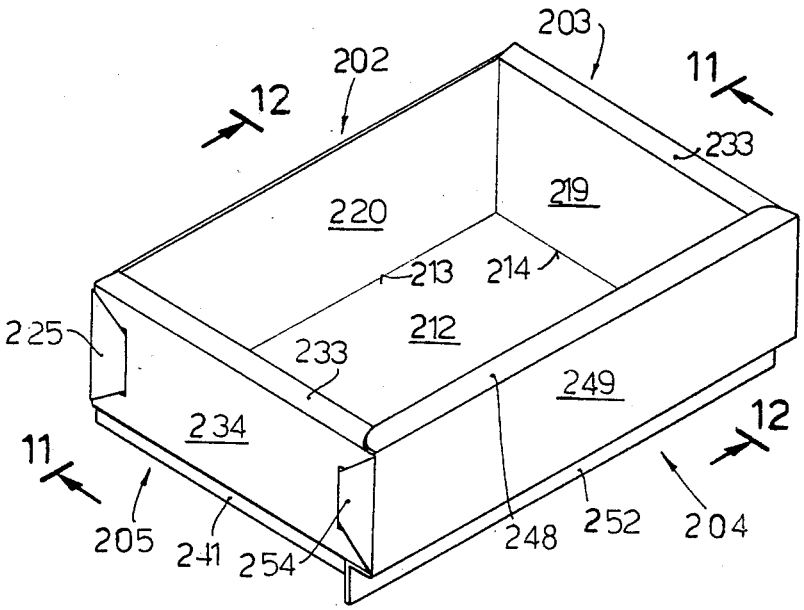

FIG. 10 is a perspective view of the container obtained by means of folding the sheet of FIG. 9.

Figure 11:
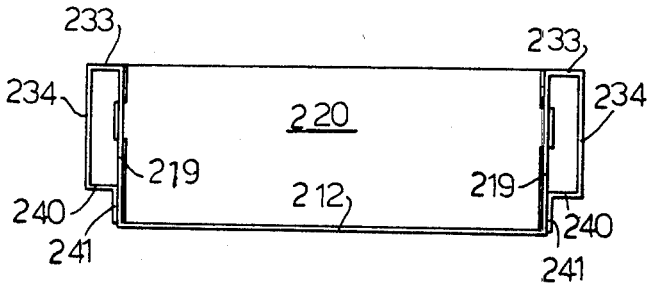

FIG. 11 is a lengthwise section along the container of FIG. 10, along the plane 11—11 in said Figure.

Figure 12:
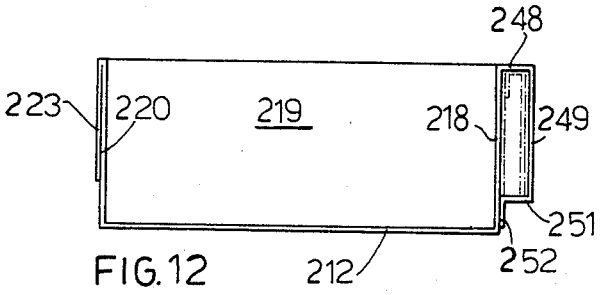

FIG. 12 is a cross-section along 12—12 in FIG. 10.

Figure 13:
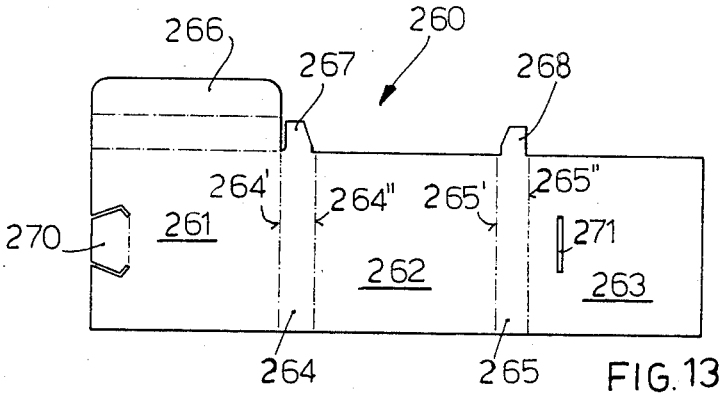

FIG. 13 is a plan view of an auxiliary member designed to stiffen the walls of the container of FIG. 10.

Figure 14:
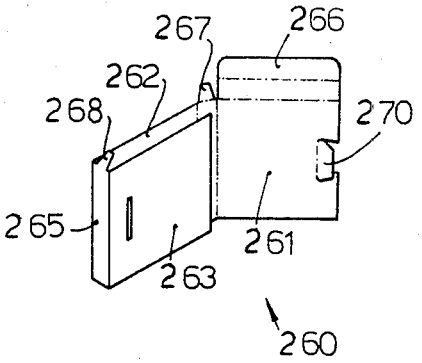

FIG. 14 is a perspective view of the member of FIG. 13, half-folded.

Figure 1:
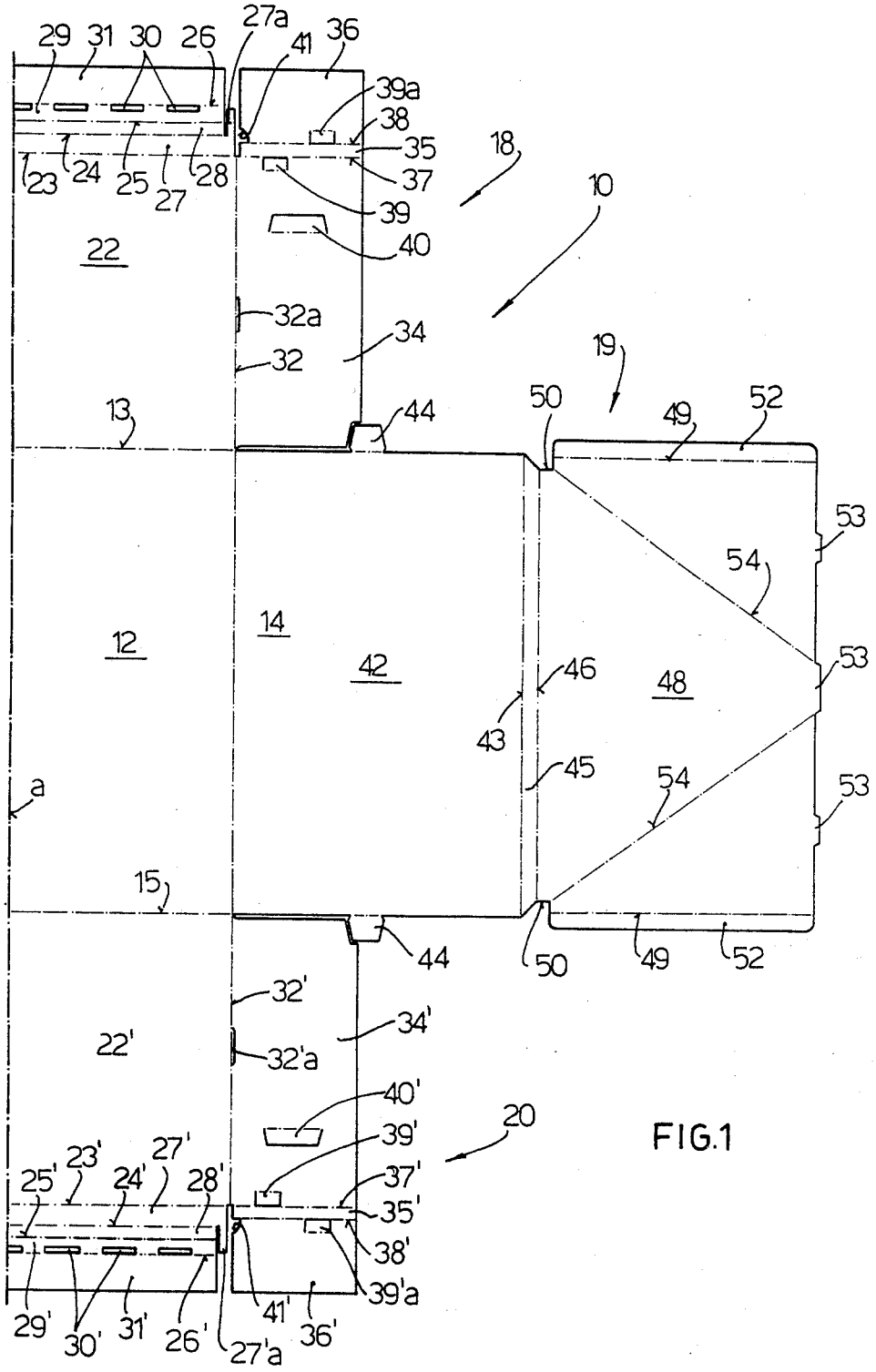
FIG. 1 is a plan view of a blank article, shown spread out and in part only, while the part that is not shown, is symmetrical in relation to an axis a that is shown in FIG. 1 by means dotted lines.
Figure 8:
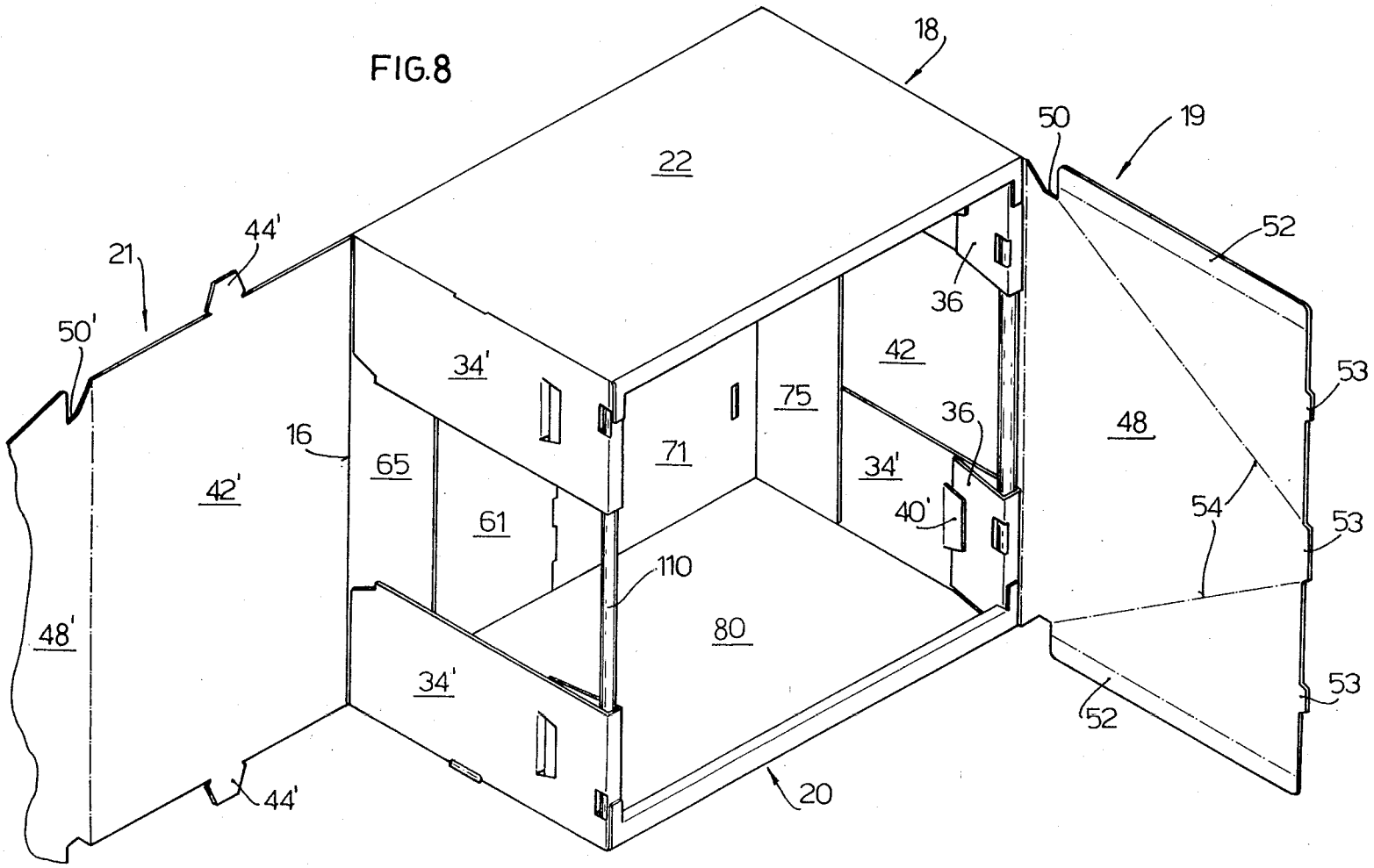
FIG. 8 is a broken perspective view of the partially assembled object.

In a first object (FIGS. 1 to 8), a first member 10, or main blank, comprises a back panel 12 that is defined by four score lines, only three of which are visible in FIG. 1 as designated by 13, 14, and 15, while the fourth line 16 is visible in FIG. 8.

Four lateral sections designated by 18, 19, 20, and 21, respectively extend beyond the score lines.

By preference, the lateral sections are equal, two by two, viz. the section 18 is equal to the section 20 opposite, and the section 19 is equal to the section 21 opposite, and for that reason, there will be given in the following the description of one section only for each pair; the homologous parts of the two equal sections are designated by the same reference number which, for one of the sections, has a prime.

Section 18 comprises a first member 22 the width of which is substantially equal to that of the panel 12. At the farthest end of the latter, four score lines 23, 24, 25, 26 define three parallel strips 27, 28, 29; the first one shows optional end projections 27*a;* in the last one, spaced notches 30 have been realized; a tongue 31 extends beyond the seam 25. At opposite sides of the member 22, seams 32 define additional lateral members 34; near the seams 32, or by their side, a notch 32*a* has been provided which eventually defines a small projecting part, while each upper member 34 is extended to form a strip 35 and a tongue 36 which are separated by means of score lines 37 and 38. A pair of small tongues 39, 39*a* are made near said score lines and are arranged facing one another, and a further tongue 40 is made at a distance from the seam 35 the height of which is, by and large, the same as that of the tongue 36. The latter has a notch 41 near the score line 38.

Section 20 has the same parts as section 18, designated in contrast by a prime, and has, more precisely, a member 22', strips 27', 28', 20', a tongue 31', score lines 23', 24', 25', 26', 32'; a notch 32'*a;* a further member 34'; small tongues 39',39'*a;* a tongue 40'; a strip 35' between the member 34' and a tongue 36'. The lateral section 19 comprises a member 42 that is defined by said score line 14 and a further score line 43. The member 42 has a width that corresponds to the adjacent side of the panel 12, and its sides have small opposite tongues 44 which, by preference, turn inward at the bottom, so as to achieve a blocking engagement, as is known in the field.

The lateral section 21 comprises the same members as 19; they are designated, by the same numbers with primes.

Beyond the score line 43, a tapered strip 45 extends that is defined by a further score line 46; beyond the latter, a further member 48 extends which has a recess 50 and the sides of which are defined by the score lines 49. The score lines 49 define small tongues 52. The far end of the member 48 is notched so as to form projecting parts 53. Two additional score lines 54 within the member 48 constitute weakening lines designed to facilitate the assembly of the object, as will be explained below.

Figure 2:
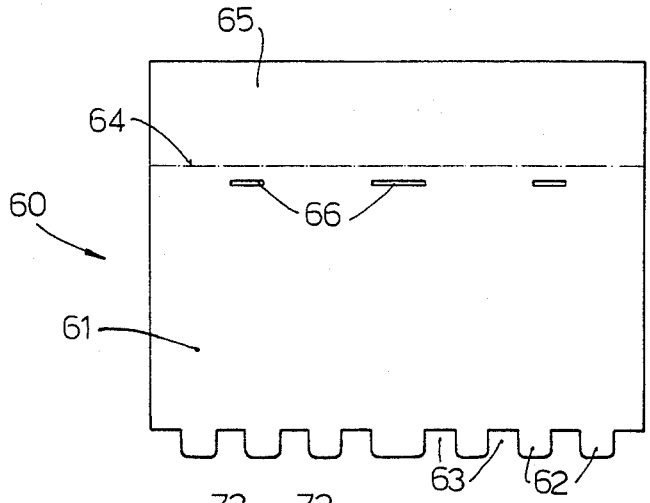
FIGS. 2 and 3 show the blanks for the reinforcement of the bottom of the object of this application.
Figure 3:
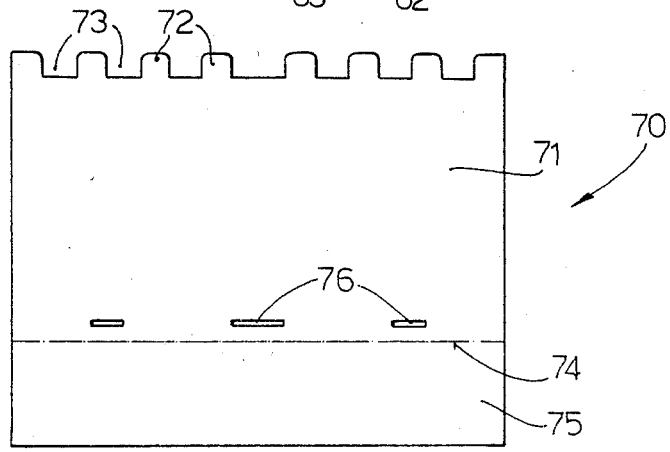
Figure 4:
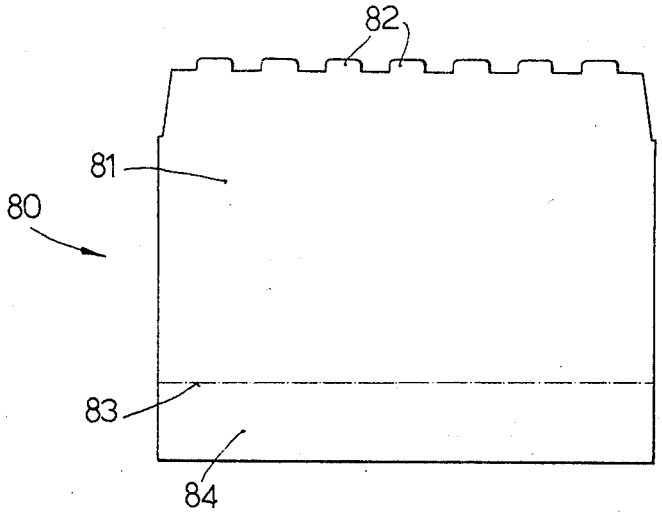
FIG. 4 shows a blank for the lateral reinforcement of the object of this application.

In the following, the members reinforcing the object of the application as shown in FIGS. 2, 3, and 4 will be described. A reinforcing member 60, in FIG. 2, comprises a panel 61 the width of which is substantially equal to the distance between the score lines 13 and 15 of the back panel 12 of the member 10. The panel 61 has teeth 62 and recesses 63 alternating on one side, and a score line 64 and a small tongue 65 on the other side. Near the score line 64, the panel 61 has notches 66 that are arranged like the projecting parts 53 of the aforementioned member 48.

The member 70 in FIG. 3 comprises a panel 71 the width of which is substantially equal to the width of the panel 61, and which presents, on one side, a series of teeth and notches 72, 73 the position and form of which correspond to the position and form of the teeth 62 of the member 60, while the teeth correspond to the notches 63 of the member 60; in addition, the panel 71 comprises an arrangement of notches similar to the notches 66, and is defined by a score line 74 beyond which a small tongue 75 extends.

The reinforcing member 80 (FIG. 4) comprises a panel 81, that preferably tapers toward an end punched in the form of teeth 82; the form and arrangement of said teeth correspond to those of the notches 30, 30' of the member 10. The panel 81 is defined, additionally, by a score line 83 beyond which a small tongue 84 extends. In the following, a blank 90 (FIGS. 5 and 6) designed to constitute a slide guide for the drawers will be described.

Member 90 comprises a central panel 91, strips 92, 93 adjacent to it on opposite sides and divided from it by score lines 94 and 95. The strip 92 is defined by a score line 96 beyond which an additional panel 97 extends that has been provided with little meshing tongues 98.

The strip 93 is defined by a mixed line consisting of a score line and a notch, 99 and 99*a,* beyond which an additional panel 100 extends that has notched lateral edges. Small tongues 101 extend from the strips 92 and 93. From the panel 91, small tongues 102 extend that are defined by a double score line 103, 104 and have a shape matching the notches of the lateral edges of the panel 100.

The component 10 is assembled by folding sections 18, 20 at an angle of 90° along the score lines 13, 15 and folding the members 34, 34' by approximately 90°, in such a way that the score lines 14, 16 will be arranged along the score lines 14', 16'. At that point, a rigid reinforcing frame 110 (FIG. 8), preferably made of steel, may be incorporated around which the score lines 23, 24, 25, 26, and 37, 38, as well as the homologous score lines for the other section, viz. 23', 24', 25', 26', and 37', 38' are folded. Small tongues 39, 39*a* and 39', 39'*a* are for engaging and returning a possible reinforcing frame. Each small tongue 36 or 36' is folded back against 24, 34', and engages the restraining tongue 40 or 40'. Each tongue 31, 31' is placed against the member 22 or 22', respectively; in that way (FIG.7), each series of strips 27, 28, 29, or 27', 28', 29', respectively, has formed an end rib for the section 18 or 20, with or without the incorporation of a reinforcing frame.

The lateral reinforcements 80 of FIG. 4 are mounted there, with the tongue 84 against the back panel 12 and the teeth 82 engaged in the notches 30 or 30'. Successively, the reinforcements 60, 70 of the bottom as shown in FIGS. 2 and 3 are mounted, against the back panel 12, seeing to it that the tongues 65 and 75 are arranged opposite the tongues 34, 34', and that the teeth and recesses 52, 63, 72, 73 are arranged interlaced among themselves, that is to say that each tooth 62 will be within the pertinent recess 73 and therefore below the member 71, and that each tooth 72 will be within the pertinent recess 63, and therefore below the member 61, in such a way as to make possible a contrasting action of each reinforcing member against the other.

Provision has been made for folding the lateral sections 19 and 21 along the score lines 14 and 16, and therefore, the seams 43, 46 can be folded; therefore, the member 48 is bent provisionally along the score lines 54, so that it may be inserted to form an internal wall of the object, and at the same time, it can be widened again by folding the samm tongues 52 along the thickness of the box wall formed in that way. The projections 53 engage themselves in the notches 66 or 76. The small tongues 44, 44' engaged in the notches 32*a*, 32'*a* take care of locking the structure. It will be found that, in that manner, a structure with some box walls and some ribbed walls has been put together that is, overall, of remarkable strength and stiffness, even when it consists of sheet (foil) material. The object obtained in this way may be used as shelf or container for books or similar articles. When it is desired to use the object as a shelf for drawers, each guide member is assembled by folding the blank 90 along the score lines 94 and 95, 96,99 so far that it will bear the panel 97 against 100, while it closes, at the same time, the little tongues 101,102 and secures the whole by means of the tabs 98 in the notches 99*a*. Each guide will be secured on the lateral wall of the structure in any suitable way, preferably by means of lengths of double-adhesive tape (not shown). By preference, the guides are fixed on the faces of the members 48 which remain exposed when the blank 10 is assembled, and which make up the vertical walls of the structure; on said surfaces, score lines or, in whatever manner, markings (not shown) may be pre-arranged in order to indicate the exact position of the guides.

For the article shown in FIGS. 9 to 14, a blank 201 comprises, essentially, a central panel 212 that is basically four-sided. The four sides of the panel are defined by score lines, only three of which are visible in FIG. 9, and which are designated as 213, 214, and 215. Beyond every one of the four score lines, there extends one of four lateral sections of the blank as designated by 202, 203, 204, and 205 in the drawings. In the rear section 202, a first rear member 220 is defined by said score line 215 and by a score line 221, and its sides are limited by cutting or shearing lines 222 only one of which is visible, and which form a step toward the outside. Beyond the score line 221, there extends a second member 223 of the rear section cut short by a cut-off line 224 and extending on the sides of the small tongues in two sections 225 and 226 that are defined by score line 225' and 226' and have been provided, by preference, with lateral locking notches 225''. A first member 219 of each lateral section 203, 205 presents a notch 219', and its sides are defined by cut-off lines 229 and 239 (preferably the latter ones in form of a step) and by a double score line 231, 232; a strip 233 is defined between the lines 231 and 232. A second member 234 of the lateral section extends beyond the score line 232. That member has, on its side, tabs 235 that may be folded by means of the score line 235' and has, near the lateral edges, button holes 236. The member 234 is further defined by a score line 237 which, together with an additional seam 238, defines an additional score line 240. A tab 241 extends beyond the score line 238.

A first member 218 of the front section has the same width as the sorresponding side of the bottom panel and, on each side, tabs 243, 244 and score lines 245. From the member 218, there extends, in a rigid way, a projecting piece 218' defined by means of a notch and hollowed out of the body of the tab 244. Toward the outside, the member 218 is defined by the score line 246. p The latter score line and a parallel seam 247 define a strip 248 the dimensions of which increase from one score line to the other. A second front member 249 extends from the score line 247 to an additional score line 250, beyond which a further strip 251 is substantially of the same height as the strip 248, and which is shaped with a notch 251'. A tab defined by a score line 253 terminates the front section of the blank.

The second front member 249 has a width exceeding the width of the first member 218, and its sides come to an end in the form of a small wing consisting of two parts and defined by the score lines 254'*n* 255' and, by preference, provided with locking notches 255'. A stiffening member 260 (FIGS. 13 and 14) which it is possible to punch out of said sheet of the blank 201, comprises three panels 261, 262, 263 that are separated from one another by the strips 264, 265 which are defined by the score lines 264', 264'' and 265', 265''. They, together with a system of tabs 266, 267, 268 make it possible to fold the member 260 in the form of a parallelepiped, and a tab 270 hollowed-out of the panel 261 is fastened in a notch 271 of the panel 263. But, it is obvious that the use of any other reinforcing member of any kind having a similar shape is possible. The blank 210 is folded, so as to form a container, as is clearly evident from the sectional drawings and from the perspective view. For the rear section, the member 220 is folded along the score line 215, at an angle of 90° in relation to the panel 212, and the member 223 is folded along the seam 221 on the outside and against the member 220. The two members may be fastened by glueing. In other words, for an observation point on the surface of the panel 212 and designed to be internal, the fold 215 is concave, while the fold in 221 is convex.

For each lateral section, the score line 214 is folded in a concave way at an angle of 90° in relation to the panel 212; score line 231, and 232 (are folded) in a convex manner, and 237 is folded in a convex manner, while 238 is folded in a concave way, so that a box-like wall structure will be formed, defined by the members 219 and 234 and the strips 233 and 240, while the tongue 241 is located on the outside against the outer surface of the member 219 near the panel 212 and may be fixed by glueing.

Inasmuch as the front section 204 is concerned, the score line 213 is folded concavely at an angle of 90°, 246, 247, 250 are folded in a convex way, while 253 is folded in a concave way, so that a box-wall defined by the members 219, 249 and by the strips 248 and 251 will be formed, while the tongue 252 is located on the outside opposite the outer surface of the member 218, near the panel 212, and may, according to any need that may arise, be glued to it. The tongues 235, 235(?), and 244 will then be folded, so as to form the outermost sides of the pertinent box-like walls; each projection 218' becomes engaged in a notch 219'; then, the tongue parts 225, 254 are folded opposite to each member 234 and the end parts of the tongues 226 and 225 are inserted into the notches 236 so as to close the structure of the container.

In that way, a container as seen in perspective in FIG. 10 has been achieved; it comprises a bottom consisting of the panel 212, and side walls some of which have a box-like shape; among the latter, a stiffening member 260 of parallelepiped shape may be inserted as shown in FIGS. 13 and 14, or an analogous member, e.g. made of wood, as reinforcement; it will be noted that the container formed in that way has recesses on the sides near the bottom that correspond to the tabs 241; and, for that reason, it is particularly suitable to be used as a drawer, inasmuch as said recesses may be used as skiding support on sliding guides (not shown) in a support structure. In that case, the notch 251' constitutes a means of holding on for pulling out the drawer.

It should also be noted that the blank may assume an intermediate, partially assembled, flattened form (not shown) that is particularly useful for storage or shipping; in the case of that form, the score lines 221, 232, 247 are folded in a convex shape, and the member 223 and the tabs 241, 252 are glued in their respective final positions.

The articles may be made of any sheet material that is sufficiently strong and pliable; an actually preferred material is a multi-layered plasticised cardboard. The article shown in FIGS. 1 to 8 is particularly suitable for use as container or shelf, or as a support structure for drawers; the article shown in FIGS. 9 to 14 is suitable for use as container or as drawer for the foregoing structure.

I claim:

1. A plurality of blanks for forming a box-like structure, a plurality of slideways, and a plurality of drawers, comprising:

a first blank including a rectangular back panel defined by two pairs of opposed score lines, a plurality of panel members extending outwardly from said score lines, said panel members foldable on each other to form, respectively, a bottom wall, an upper wall and side walls each connected to the back panel;

a plurality of slideway blanks for defining hollow rectangular slideways for application on inner surfaces of said side walls of said first blank;

a plurality of second blanks including a rectangular central panel defined by two pairs of opposed score lines, a plurality of panel members extending outwardly from said score lines, said panel members foldable relative to each other to form a hollow front wall, a back wall, and hollow side walls, said side walls having a rectangular cross section and each having a longitudinal offset for sliding engagement with said slideways;

said first blank when folded defining a self-supporting, box-like, drawer-supporting structure having an open front for slidably receiving a plurality of drawers carried on said guideways;

each said second blank when folded being a self-supporting box-like structure in the form of a drawer that is slidably received in the supporting structure formed from said first blank structure.

2. A plurality of blanks as claimed in claim 1, wherein said first blank comprises two side sections, a bottom section and a top section, said side sections being substantially identical to each other, said bottom and top sections being substantially identical to each other, each said side section comprising a first member defined by a first score line, a strip defined by a second score line and having tapered ends, an outer member hingedly connected to said strip, said outer member having recessed adjacent said second score line and being foldable to lie adjacent said first member but spaced therefrom to form a box-like wall;

each said top and bottom wall comprising a first member defined by a score line, a first, a second and a third rectangular strip parallel to each other and defined by score lines, said first, second, and third strips being foldable on said score lines to form a box-like reinforcing rib along an edge of said first member.

3. A plurality of blanks as claimed in claim 2 further comprising back panel reinforcing members in the form of flat blanks, said members having alternating teeth and recesses on a pair of edges facing each other, said teeth of both panels, when the structure is assembled, being in an interlaced arrangement and portions of said edges facing and being in abutting relation to each other.

4. A plurality of blanks as claimed in claim 1, wherein said slideways are each assembled from a blank divided into rectangular panels by a plurality of score lines.

5. A plurality of blanks as claimed in claim 1, wherein each said second blank includes side sections comprising a first panel member extending from said central panel and defined by a first score line spaced from and parallel to an edge of said central panel, a first strip between said first score line and a second score line spaced outwardly of and parallel thereto, a second panel member outwardly of said second score line, said second panel member having substantially the same width as said first member but a smaller length, a second strip outwardly of said second panel member, and a tab outwardly of and hingedly connected to said second strip, said tab having a smaller width than said second strip, said longitudinal offset in the assembled article formed from said second blank being defined by said second strip and said tab, folded to lie adjacent to a portion of said first panel member.

6. A box-type article having drawers and formed from a plurality of flat blanks, said article comprising:

(a) an enclosure formed from a first blank including a rectangular back panel defined by two pairs of opposed score lines, a plurality of panel members extending outwardly from said score lines, each of said panel members being foldable on itself to form, respectively, a bottom wall, a upper wall, and side walls, each of which is connected with the back panel and each of which includes a frame panel between said folded panel members, said enclosure having an opening surrounded and defined by said frame panels of said blank, said frame panels lying in a single plane and forming a frame around said opening;

(b) a plurality of generally rectangular slideways secured to the inner surfaces of said side walls, said slideways each formed from a blank having a plurality of connected rectangular panels to define an elongated hollow rectangular member having a rectangular cross section when assembled, said slideways having a longitudinal axis substantially perpendicular to said back panel;

(c) a plurality of drawers, each drawer defined by a second blank including a rectangular central panel defined by two pairs of opposed score lines, a plurality of panel members extending outwardly from said score lines, said panel members foldable about their respective score lines to define a hollow front wall, a back wall, and hollow side walls, said side walls having a rectangular cross section and each said side wall having a longitudinal offset for sliding engagement with said slideways;

(d) said first blank when folded defining a self-supporting box-like drawer-supporting structure having an open front for slidably receiving a plurality of drawers carried on said slideways, each said second blank when folded being a self-supporting, box-like structure in the form of a drawer having overhanging side panels defined by said longitudinal offset and that are slidably received in the supporting structure formed from the first blank and slidable along said slideways.

7. A box-like article as claimed in claim 6, wherein said first blank comprises two side sections, a bottom section and a top section, said side sections being substantially identical to each other, said bottom and top sections being substantially identical to each other, each said side section comprising a first member defined by a first score line, a strip defined by a second score line and having tapered ends, an outer member hingedly connected to said strip, said outer member having recesses adjacent said second score lines and being foldable to lie adjacent said first member but spaced therefrom to form a box-like wall;

each said top and bottom wall comprising a first member defined by a score line, a first, a second and a third rectangular strip parallel to each other and defined by score lines, said first, second, and third strips being foldable on said score lines to form a box-like reinforcing rib along an edge of said first member.

8. A box-like article as claimed in claim 7 further comprising back panel reinforcing members in the form of flat blanks, said reinforcing members having alternating teeth and recesses on a pair of edges facing each other, said teeth of both panels, when the structure is assembled, being in an interlaced arrangement and portions of said edges facing and being in abutting relation to each other.

9. A box-like article as claimed in claim 6, wherein said slideways are each assembled from a blank divided into rectangular panels by a plurality of score lines.

10. A box-like article as claimed in claim 6, wherein each said second blank includes side sections comprising a first panel member extending from said central panel and defined by a first score line spaced from and parallel to an edge of said central panel, a first strip between said first score line and a second score line spaced outwardly of and parallel thereto, a second panel member outwardly of said second score line, said second panel member having substantially the same width as said first member but a smaller length, a second strip outwardly of said second panel member, and a tab outwardly of and hingedly connected to said second strip, said tab having a smaller width than said second strip, said longitudinal offset in the assembled article formed from said second blank being defined by said second strip and said tab, folded to lie adjacent to a portion of said first panel member.

* * * * *